United States Patent [19]

Tomer

[11] Patent Number: 4,790,523

[45] Date of Patent: Dec. 13, 1988

[54] METHOD AND A SYSTEM FOR DISPLACING OBJECTS

[75] Inventor: David Tomer, Haifa, Israel

[73] Assignee: Galram Technology Industries Ltd., Haifa, Israel

[21] Appl. No.: 897,837

[22] Filed: Aug. 19, 1986

[30] Foreign Application Priority Data

Sep. 2, 1985 [IL] Israel ..... 76277

[51] Int. Cl.[4] ..... B41L 43/12

[52] U.S. Cl. ..... 270/37; 112/121.11; 112/121.29

[58] Field of Search ..... 270/37, 53, 58; 112/121.11, 121.29, 121.14, 262.3, 262.1, 65

[56] References Cited

U.S. PATENT DOCUMENTS

| | | | |
|---|---|---|---|
| 3,611,957 | 10/1971 | Beazley . | |
| 3,611,961 | 10/1971 | Lopez et al. | 270/58 |
| 3,664,657 | 5/1972 | Hawley et al. | 270/58 |
| 3,669,443 | 6/1972 | Noiles | 112/121.11 |
| 3,670,674 | 6/1972 | Conner, Jr. | 112/121.29 |
| 3,670,675 | 6/1972 | Rovin et al. | 270/53 |
| 3,773,002 | 11/1973 | Burton | 112/262.3 |
| 3,780,682 | 12/1973 | Frost | 112/121.29 X |
| 3,867,889 | 2/1975 | Conner, Jr. | 112/121.11 |
| 3,951,400 | 4/1976 | Blessing et al. | 112/121.29 X |
| 3,970,021 | 7/1976 | Meadows et al. | 112/121.29 |
| 4,074,640 | 2/1978 | Chano et al. | 112/121.11 |
| 4,095,537 | 6/1978 | Silverman et al. | 112/121.29 |
| 4,112,860 | 9/1978 | Ellington et al. | 112/121.29 |
| 4,589,361 | 5/1986 | Starnes et al. | 112/262.3 |
| 4,592,295 | 6/1986 | Cordier | 112/121.29 |
| 4,621,585 | 11/1986 | Ball et al. | 112/121.29 |
| 4,624,198 | 11/1986 | Beam et al. | 112/121.11 X |

FOREIGN PATENT DOCUMENTS

| | | | |
|---|---|---|---|
| 0020259 | 12/1980 | European Pat. Off. | 112/121.11 |
| 3217202 | 11/1982 | Fed. Rep. of Germany | 112/121.11 |
| 2097153 | 10/1982 | United Kingdom | 112/121.11 |

*Primary Examiner*—E. H. Eickholt

*Attorney, Agent, or Firm*—Browdy and Neimark

[57] ABSTRACT

A method and system for displacing objects, particularly flexible fabric layers, into a predetermined relative disposition wherein the objects are deposited on a supporting surface in a relatively spaced apart disposition, positional coordinates of each object are successively sensed and data relating thereto are stored in a programmed central processor unit, each object being then displaced with respect to a succeeding object, in an order reverse to the order of sensing so as to locate each object in a predetermined relative (preferably superimposed) disposition with respect to the position of the succeeding object as stored in the processor unit.

15 Claims, 13 Drawing Sheets

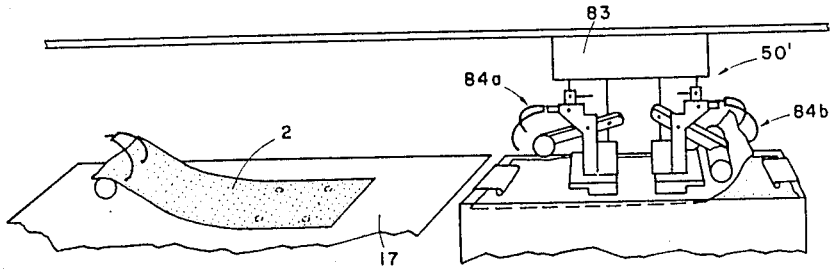
Fig.6a
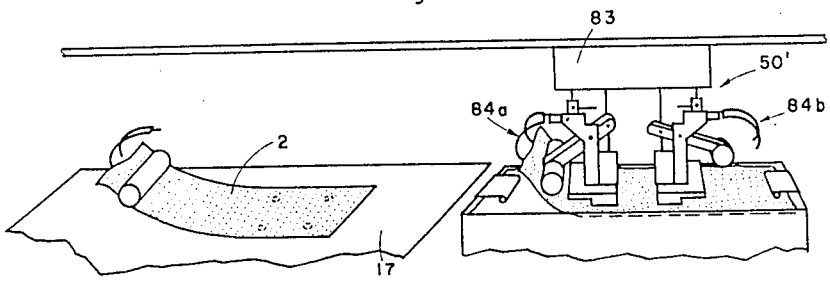
Fig.6b
Fig.11
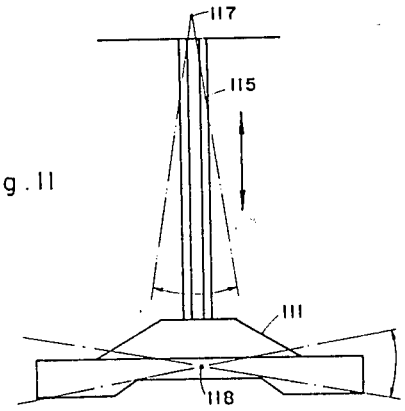

METHOD AND A SYSTEM FOR DISPLACING OBJECTS

BACKGROUND OF THE INVENTION

This invention relates to a method and a system for displacing objects into a predetermined relative disposition. The invention is particularly, but not exclusively, concerned with the displacement of substantially planar, relatively flexible fabric layers into a relatively superimposed dispostion and for the subsequent displacing of the thus superimposed layers into a position ready for hemming or other sewing operation.

The necessity for such relative superimposition of flexible fabric layers often arises in the textile industry such as, for example, in the manufacturing of shirts, where various of the short components such as, for example, shirt cuffs, collars, epaulets, pocket flaps, etc., hereinafter generically referred to as "shirt small parts", generally consist of at least two layers of shirt material often with an interposed lining material.

Such shirt small parts are manufactured separately from the main portion of the shirt garment and are then separately attached to this main portion.

To this end the various flexible layer components of the shirt small parts have hitherto been manually assembled by operators into the required superimposed disposition, including the folding over, where necessary, of the various constituent parts and, after such assembly the operator manually loads the multi-layer assembly into a receiving station of an appropriate hemming unit where the assembly is hemmed and trimmed so as to be ready for subsequent attachment to the garment.

It will be readily appreciated that manual assembly and loading by an operator substantially increases the labour content in the manufacturing costs and therefore is a very important factor in keeping production costs high. This factor is, of course, of very considerable significance where manufacture takes place in a country where labour costs are inherently high.

SUMMARY OF THE INVENTION

It is an object of the present invention to provide for a new and improved method and system for displacing objects into a predetermined relative disposition wherein the above referred to disadvantages, which have been elaborated on in connection with the displacement and assembly of fabric layers, are substantially reduced or avoided.

According to the present invention, there is provided a method for displacing objects into a predetermined relative disposition comprising the steps of:

(a) depositing said objects on a supporting surface in a relatively spaced apart disposition;

(b) successively sensing positional coordinates of each object and storing data relating to said coordinates in a programmed central processor unit;

(c) displacing each object with respect to a succeeding object, in an order reverse to the order of sensing so as to locate each object in a predetermined relative disposition with respect to the position of said succeeding object as stored in said processor unit.

Preferably, the objects are constituted by flexible fabric layers, each object having pairs of orthogonally disposed rectilinear edges, successive sensing of each edge of a pair providing information concerning the positional coordinates of each edge and its relative angular disposition.

In accordance with a preferred embodiment, the fabric layers are successively displaced into a predetermined superimposed disposition, one of the layers having a projecting edge portion which is bent over, the superimposed layers with the bent over edge portion being presented to a hemming unit for hemming.

In accordance with a further aspect of the present invention there is provided a system for displacing objects into a predetermined disposition comprising:

depositing means for depositing said objects on a supporting surface in a relatively spaced apart disposition;

sensing means for successively sensing positional coordinates of each object and transmitting data relating to said coordinates for storage in a programmed central processor unit; and displacing means for displacing each object with respect to a succeeding object in an order reverse to the order of sensing so as to locate each object in a predetermined relative disposition with respect to the position of said succeeding object as stored in said processor unit.

Preferably, the objects consist of substantially rectangular fabric layers, the sensing means comprising a tracking arm, a pair of spaced apart optical sensors carried by the tracking arm, arm displacing means for displacing the tracking arm over the supporting surface in any required direction and means for sensing and transmitting to a central processing unit signals emitted from the sensors as they cross edges of the flexible layers.

Preferably the depositing means includes a layer gripping and displacing device comprising a clamping surface, pivotally clamping fingers, air suction means for displacing by suction a planar layer froma a layer container holder onto the clamping surface and clamping fingers displacement means for pivotally displacing the fingers into clamping engagement with the clamping surface.

Preferably, successive lengths of a first layer are attached to a continuous length of a lining material at spaced apart intervals, the continuous length being fed to the supporting surface on which the continuous length is successively severed so as successively to deposit on the surface successive first layers. Preferably a length dimension of each first layer is measured and stored in the central processing unit as each first layer is fed to and deposited on the surface.

In the embodiment where a plurality of fabric layers are displaced into a relatively superimposed disposition with one of the layers projecting beyond the remaining layer(s), folding means are provided for folding over the projecting portion over the adjacent edges of the remaining layer(s).

This folding means can suitably be formed of a plurality of aligned tubular members mounted for free rotation about an axis substantially parallel to said surface and capable of limited movement towards and away from said surface, said displacing means being designed to displace the superimposed planar objects towards and under said tubular elements, air blow means being provided for raising the projecting portion from said surface prior to passing under said aligned tubular elements whereby said projecting portion is folded over by the pressure exerted by said tubular elements.

A loading mechanism can be provided which is adapted to receive and releasably to retain the superimposed flexible layers and to dislace same to a loading station, where they can be presented for processing to a hemming unit.

Where the method and system in accordance with the present invention is employed for the purposes indicated above, namely in the preparation of multilayer small shirt parts, a very considerable speeding up in the preparation and manufacture of these small shirt parts is achieved and this considerably reduces the costs involved.

BRIEF DESCRIPTION OF THE DRAWINGS

For a better understanding of the present invention and to show how the same may be carried out in practice, reference will now be made to the accompanying drawings in which:

FIGS. 6*a* and 6*b* are views of a modified form of inner layer gripping and displacing device showing respective alternating layer displacement modes;

FIG. 11 shows schematically the directions of freedom of motion of the loading mechanism shown in FIGS. 9 and 10;

DETAILED DESCRIPTION OF THE INVENTION

The automatic handling and loading system now to be described has been specially designed for the automatic assembly and handling of the constituent components of shirt cuffs and the loading thereof into a suitable cuff hemming unit.

Figures 1A, 1B, 1C, 1D, 1E:
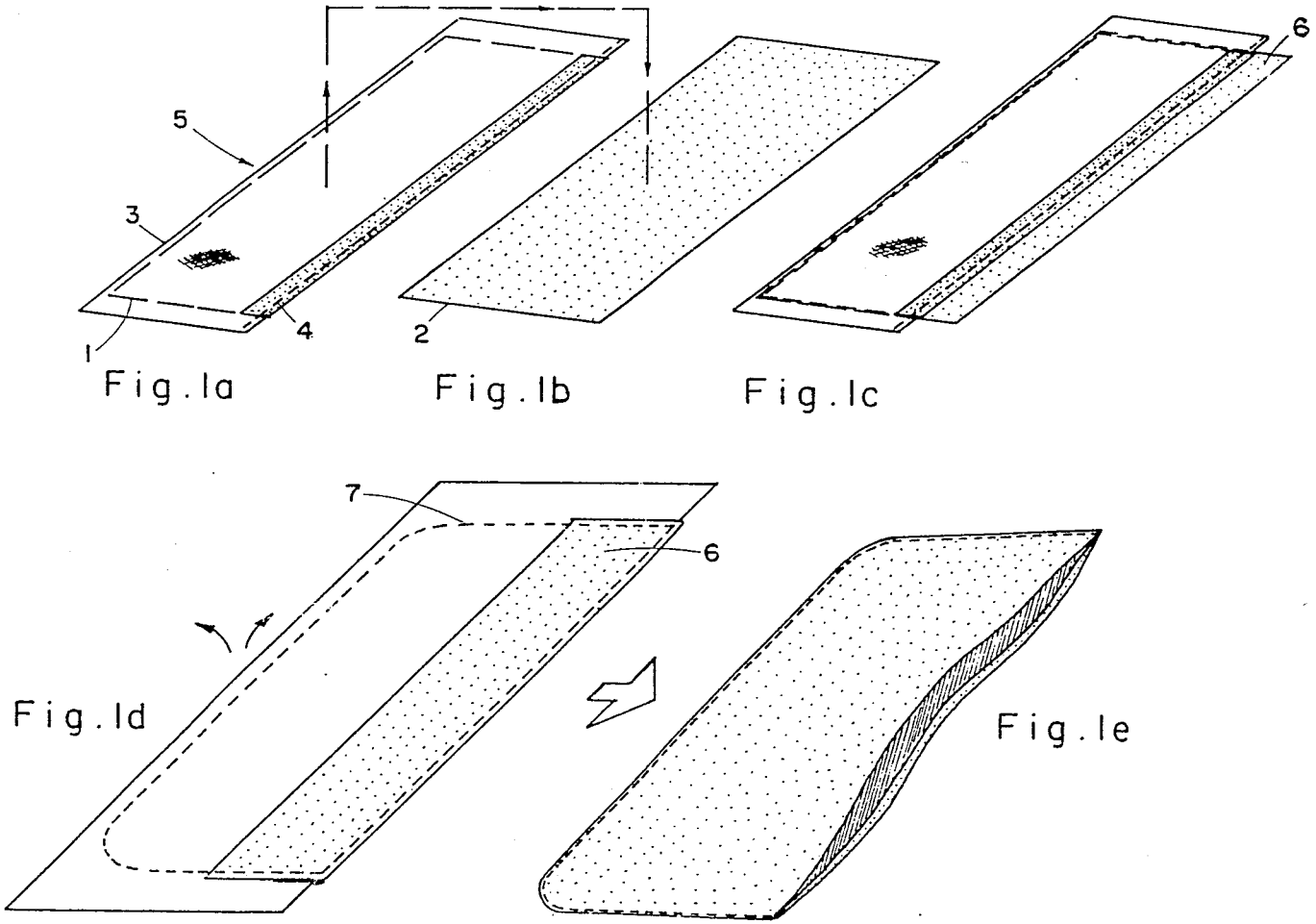
FIGS. 1*a*, 1*b*, 1*c*, 1*d* and 1*e* show the various stages in the assembly together and subsequent hemming of the constituent layers of a shirt cuff.

There will now be described with reference to FIGS. 1*a*–1*e* of the drawings the basic components of a shirt cuff and their processing so as to form a shirt cuff. As seen in the drawings, the two basic components comprise an outer cuff layer 1 (FIG. 1*a*) and an inner cuff layer 2 (FIG. 1*b*). The outer cuff layer 1 has attached to it a lining layer 3, the transverse edges of the lining layer 3 extending beyond the transverse edges of the cuff layer 1. A longitudinal edge portion 4 of the cuff layer 1 is bent over and stitched to the lining layer 3. The outer cuff layer 1 and the attaching lining layer 3 together form an outer cuff unit 5.

The inner and outer cuff layers 2 and 1 are of rectangular shape and of identical lengths. The outer cuff unit 5 is superimposed on the inner layer 2 so that a longitudinal edge portion 6 thereof projects beyond the edge portion 4 of the outer layer 1 (FIG. 1*c*). This projecting edge portion 6 is now bent back so as to be superimposed on the edge portion 4 and in this position the inner and outer layers 2 and 1 and the lining layer 3 are stitched together with a hemming stitch 7 (FIG. 1*d*). The thus stitched together layers are then subjected to edge trimming and the entire assembly is then turned inside out as shown in FIG. 1*e* in which condition the cuff is ready for attaching to a shirt sleeve.

Figure 2:
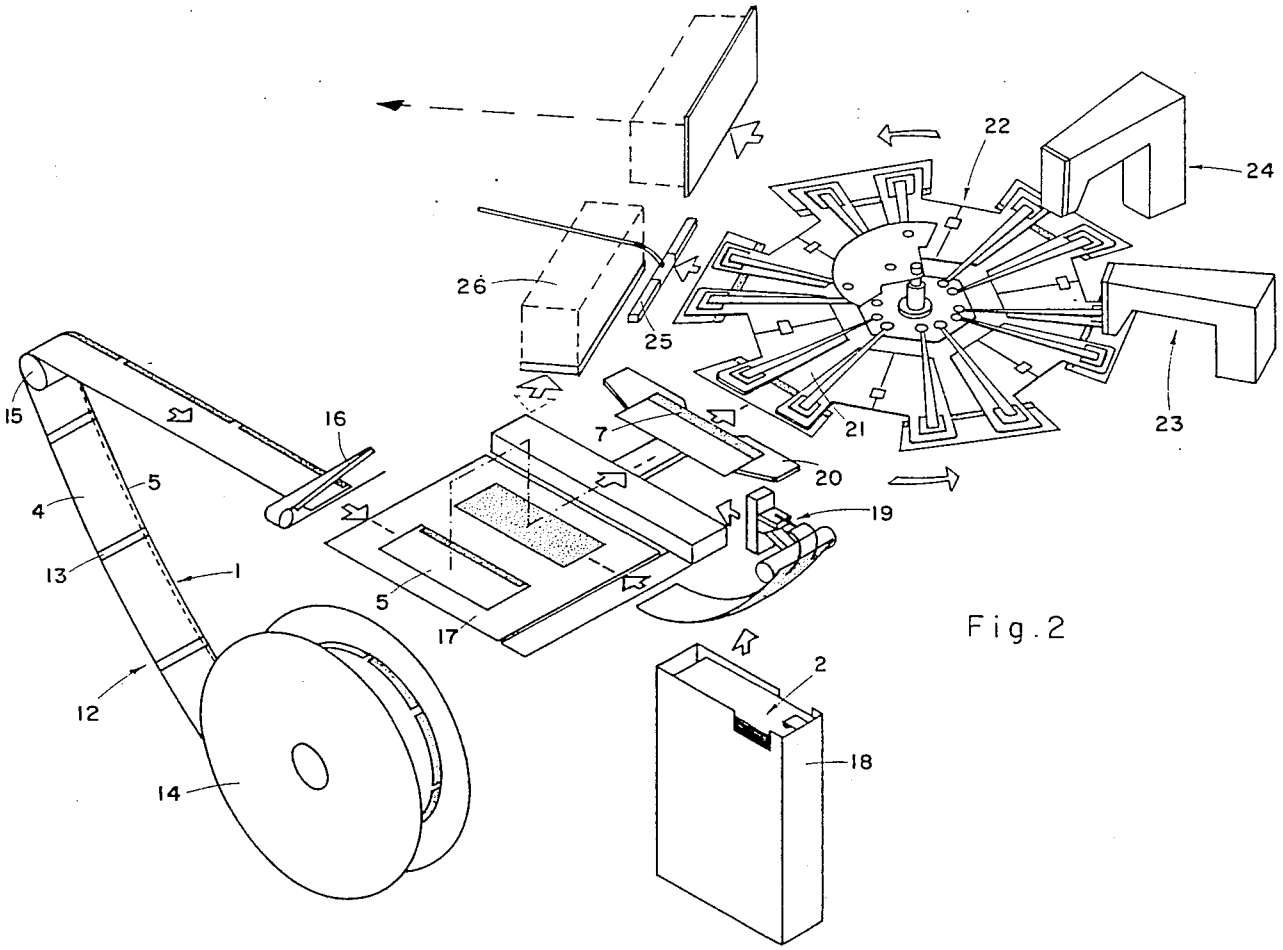
FIG. 2 is a schematic representation of the assembly together and subsequent hemming of the constituent layers to form a shirt cuff using the method and system in accordance with the present invention for displacing the cosntituent layers into a predetermined relative disposition.

Reference will now be made to FIG. 2 of the drawings for a schematic description of the automatic cuff layers handling and loading system and its mode of operation. As seen in FIG. 2 the outer cuff layers 1 are secured to a continuous lining length 12 and the turned over edges 5 of the layers 1 are stitched to the corresponding edge of the lining length 12. Adjacent cuff layers 1 are separated from each other by gaps 13. The continuous lining length 12 and attached cuff layers 1 are stored on a roll 14 from which the continuous length passes over a guide roller 15 through a knife mechanism 16 which severs the successive outer cuff units 5 from each other at the respective gaps 13. Each severed outer cuff unit 5 is deposited on an assembly surface 17.

A stack of inner cuff layers 2, loaded in a "face-down" condition, is located in a holder 18 from which successive inner layers 2 are extracted by an extracting mechanism 19 so as to be deposited on the assembly surface 17 adjacent to and spaced from the outer cuff unit 5.

The outer cuff unit 5 is then displaced by means to be described below so as to be superimposed on the inner cuff layer 2 with the longitudinal edge portion 6 of the latter projecting beyond the superimposed outer cuff unit 5. The superimposed assembled inner and outer layers 2 and 1 are then displaced by means to be described below, with the edge portion 6 held folded over the outer cuff unit 5 and, in this condition, is presented by a loading mechanism 20 to one of a plurality of receiving stations 21 of a cuff hemming unit 22. This cuff hemming unit 22 is of a commercially available type and will not be described in any detail apart from stating that the receiving stations 21 successively present the assembled layers to a sewing head 23 and a trimming head 24 and thereafter for removal by a removing rake 25 to a stacking station 26 from whence the stacked assembled layers are displaced for loading.

Figure 3:
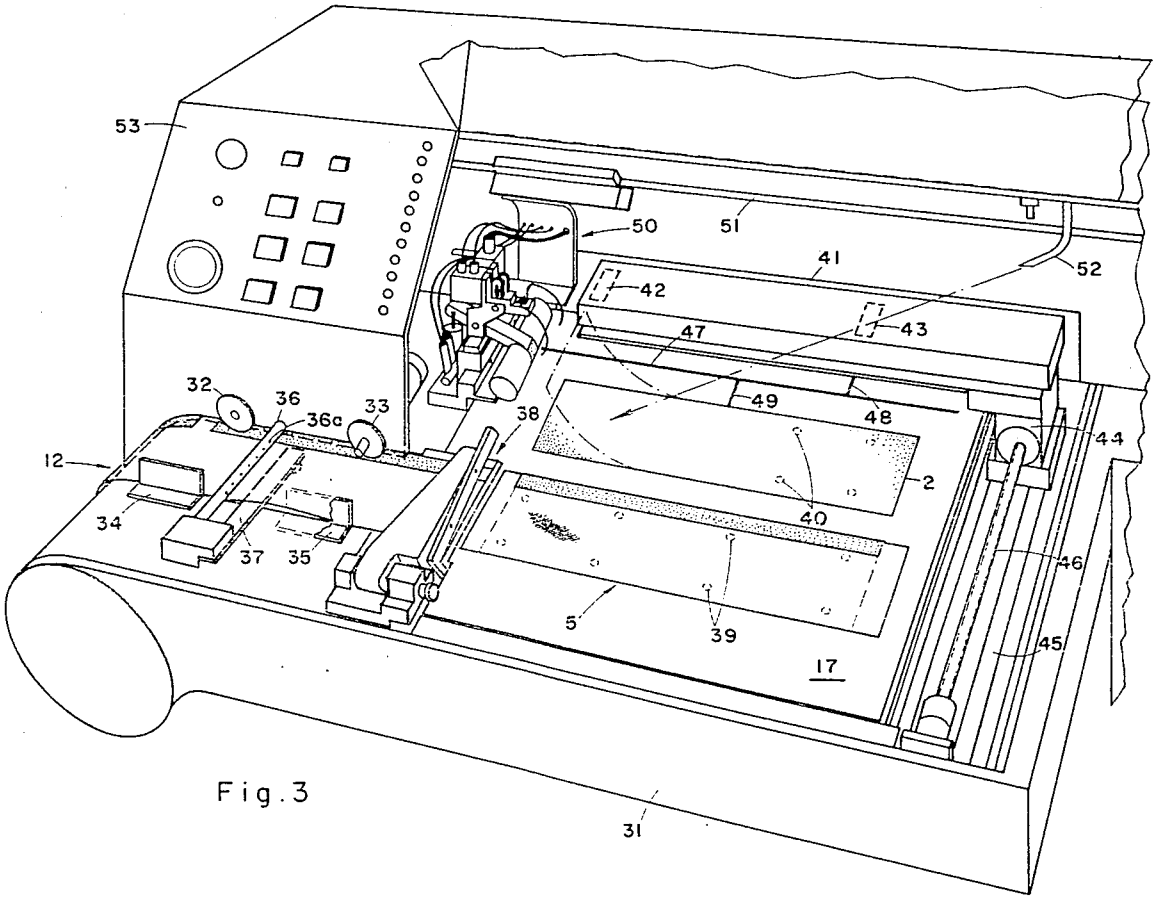
FIG. 3 is a perspective view of an assembly table forming part of the system in accordance with the present invention.

Reference will now be made to FIG. 3 of the drawings for a detailed description of the equipment and process involved in depositing successive outer cuff units 5 on an assembly surface 17 for subsequent assembly with corresponding inner layers 2.

As seen in this drawing, the assembly surface 17 forms an integral part of an assembly table 31. The lining length 12 with the outer layers 1 attached thereto is fed onto the assembly table 31 from the roll 14 so that one longitudinal edge thereof passes successively under a distance sensing (encoder) roller 32 and a drive roller 33. The opposite longitudinal edge of the length 12 is restrained from lateral movement by a pair of spaced apart guide abutments 34 and 35. Downstream of the encoder roller 32 is an air blower unit 36 which extends transversely over the length 12 and a reflector bar 37 which extends between the upper lining layer 3 of the length 12 and the lower outer cuff layers 1. The air blower unit 36 is formed with downwardly directed air holes **36*a* so that a downwardly directed air blast impinges on the length 12, passing through the highly pervious lining layer 3 and pressing the much less pervious cuff layers 1 to the assembly table surface 17**.

The reflector bar 37 is formed with a lower reflecting surface and located in the table 31 below the reflector bar 37 is a light source (not shown) and a light receiving cell (not shown).

Downstream of the drive roller 33 and aligning bracket 35 is a knife mechanism 38. Formed on the assembly surface 17 of the assembly table 31 along the portion thereof which, as seen in FIG. 3 of the drawings is occupied by a severed outer cuff unit 5, is a plurality (4) of vacuum hole pairs 39 whilst formed on the upper region of the assembly surface 17 in the location to be occupied by an inner layer 2 and on the righthand side of that region are two pairs of vacuum holes 40.

A cuff layer tracking and displacing arm 41 is provided with a pair of optical sensors 42 and 43. The arm 41 is shown mounted at one end thereof on a displacement base 44 which can travel in an Y direction between guide rails 45, its movement in this direction being imparted to it via an externally threaded screw rod 46.

The arm 41 is also capable of and is provided with means (not shown) for movement in the X direction and for rotary movement with respect to an axis directed normally to the surface 17 about an angle defined as $\theta$.

The arm 41 is also capable of movement vertically with respect to the assembly surfaces 17 (i.e. in the Z direction) and this between two positions, in a first of which the arm 41 presses against the surface 17 and in a second of which the arm is raised a fixed distance from the surface 17.

The assembly surface 17 is provided with a Y direction zeroing line 47 and an X direction zeroing line 48 and a median positioning line 49.

The equipment is furthermore provided with an inner layer gripping, displacing and depositing device 50 to be described in detail below which is displaceable in the X direction along a rail 51. There is furthermore provided an air blast nozzle 52 from which an air blast is directed onto the region of the inner layer 2 when disposed on the assembly surface 17 remote from the vacuum holes 40.

Finally and with reference to FIG. 3 of the drawings, the equipment is provided with a control console 53.

The use of the equipment just described in feeding, severing, displacing and locating successive outer cuff units 5 on the assembly surface 17 and, at the same time sensing and storing in a programmed central processor unit data concerning the length of the individual outer layers 1 of the units 5 will now be described.

The continuous length 12 is fed onto the table 31 so that the longitudinal edge portions 6 pass successively under the encoder and drive rollers 32 and 33 whilst the opposite longitudinal edge of the length 12 abuts the guide abutments 34 and 35. At the same time an air blast from the air blast unit 36, via the downwardly directed air holes **36*a*, passes through the highly pervious lining layer 3 and presses the successive cuff layers 1 onto the assembly surface 17 and the separated layers pass respectively below and above the reflector bar 37. As long as the lower, reflector surface of the reflector bar 37 is masked by the cuff layer 1, light directed from the light source in the assembly table is not reflected onto the light receiving cell and no operative signal is emitted from this cell. When however the progress of the length 12 brings the region between successive cuff layers (i.e. the gap 13) below the reflecting surface of the reflecting bar 37, light is reflected from this reflecting surface onto the light receiving cell and an operational signal is transmitted from the cell to the processor unit. This signal is initiated as soon as one upstream edge of a cuff layer strip passes under the reflecting bar 37** and terminates as soon as the successive, adjacent downstream edge of the succeeding cuff layer passes under the reflecting surface.

Upon the detection of the upstream edge of the cuff layer, the knife mechanism 38 is actuated to sever the outer cuff unit 5 after the encoder roller 32 will have sensed the displacement of the strip by the appropriate distance (corresponding to the distance between the reflector bar 37 and the knife mechanism 38). At the same time and, in successive operations the encoder roller 32 senses the exact length of each outer layer 1 as this has been displaced forwardly by the drive roller 36. This length is computed by sensing the downstream edge of the cuff layer 1 and then subsequently sensing the upstream edge of the same cuff layer. The information concerning this length dimension is stored in the central processor unit. With the severing by the knife mechanism 38 of an outer cuff unit 5 and its location, as shown in FIG. 3, on the assembly surface 17, a signal from the processor unit causes the supply of vacuum to the vacuum holes 39 so as to keep the now severed cuff unit 5 in position on the assembly surface 17.

Thus, the outer cuff unit 5 is now located on the assembly surface 17, being held to the surface by the vacuum applied to the vacuum holes 39, with the central processor unit storing information relating to the exact length of this outer layer but with the positional coordinates of this outer layer 5 not being known.

Figure 4:
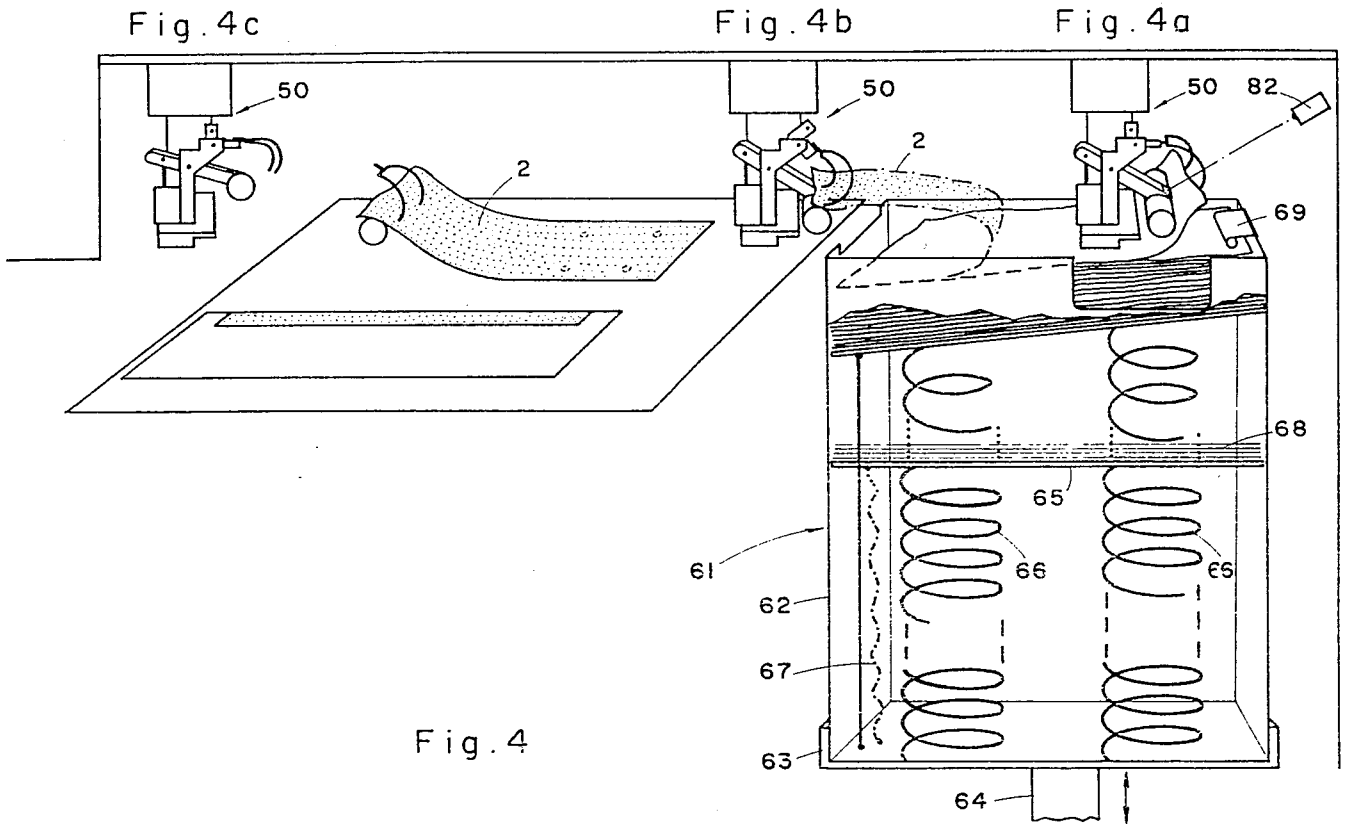
FIGS. 4*a*, 4*b* and 4*c* show an inner layer gripping and displacing device and an inner layer magazine 61 in respectively successive stages of gripping and displacing of an inner layer.
Figure 5:
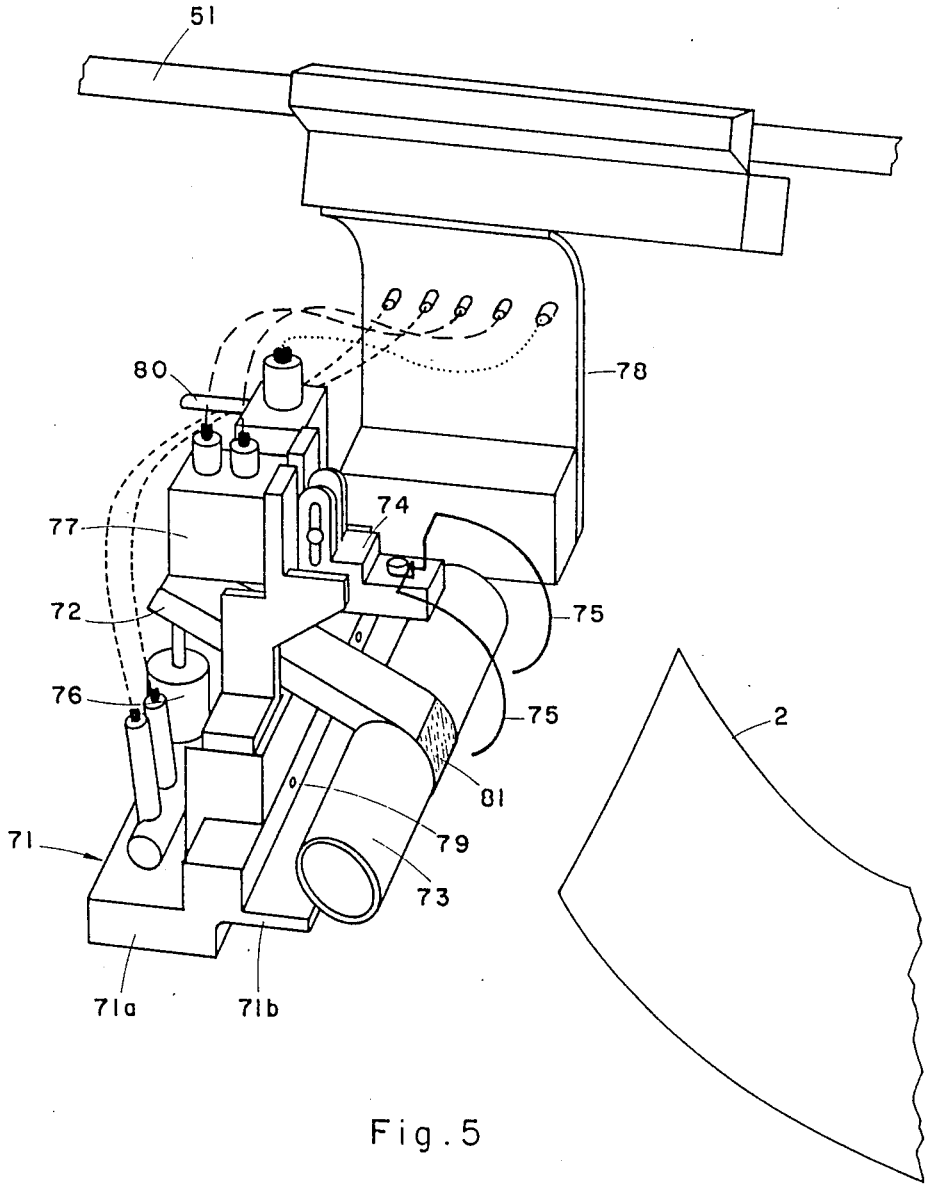
FIG. 5 is a view on an enlarged scale of the inner layer gripping and displacing device shown in FIG. 4.

Reference will now be made to FIGS. 4 and 5 of the drawings which, in conjunction with FIG. 3, will illustrate the equipment used for locating the inner cuff layers 2 on the assembly surface 17 in juxtaposition to the already located outer cuff unit 5. As seen in these Figures, the equipment consists essentially of an inner layer magazine 61 shown in FIG. 4 of the drawings and the inner layer gripping, displacing and locating device 50 shown in FIGS. 3 and 4 and in enlarged detail in FIG. 5.

As seen in FIG. 4 the magazine 61 comprises a magazine container 62 which is supported by a magazine support 63 coupled by means of a coupling rod 64 to a pneumatic displacing mechanism (not shown) by means of which the magazine container 62 can be displaced in a vertical direction. A support platform 65 is located within the container 62 and rests on a pair of compression springs 66 which serve to bias the platform 65 upwardly. The platform 65 is coupled to the base of the container 62 by means of a flexible, non-elastic coupling cord 67.

A stack 68 of inner layers 2 is disposed on the platform 65, the weight thereof being directed against the upward biasing force exerted on the platform 65 by the springs 66. A retaining catch 69 is located at one side of the upper edge of the container 62 and serves to prevent accidental spilling of the inner layers from the container 62.

It will be seen that, when the container 62 is loaded with a full stack 68 of inner layers, the weight of this stack 68 counterbalances the upwardly directed biasing force exerted by the springs 66. When however a substantial portion of the stack 68 has already been removed, the residual weight of the stack 68 may be insufficient to counterbalance the effect of the springs 66 even though these, being extended, exert lesser force. In order to prevent the undersired projection of the inner layers from the container 62 under the influence of the springs 66, the cord 67 is provided which, when extended to its full as seen in the drawings, prevents the further outward displacement of the platform 65 and thereby ensures that the remaining inner layers are retained within the container until removed by the device 50.

Thus, in effect FIG. 4 of the drawings shows the magazine container 62 in two successive positions, in a first of which it is fully loaded by a full stack with the consequence that the springs 66 are fully compressed and the cord 67 is slack and in a second of which a substantial portion of the stack has already been removed, the springs 66 are extended and the platform 65 is prevented from further upward displacement under the influence of the springs 66 as a result of it being retained to the now tightened cord 67.

The construction and mode of operation of the griping, displacing and locating device 50 will now be described.

As seen most clearly in FIG. 5 of the drawings the device 50 comprises a support frame 71 having a lowermost planar surface 71*a*. A pivotal arm 72 is pivotally supported on the frame 71 and carries, at an end thereof, a cylindrical element 73. Also pivotally supported on the support frame 71 is a pivotal support bracket 74 which carries a pair of curved clamping fingers 75 formed integrally with an offset frame flange 71*b*. The support frame 71 carries a first pneumatic displacement mechanism 76 for pivotal displacement of the cylindrical element 73 and a second pneumatic displacement mechanism 77 for pivotal displacement of the clamping fingers 75. Pneumatic supply lines for the mechanisms 76 and 77 pass through a control unit 78 which is responsively coupled to the central processor unit, the entire device being supported from the rail 51.

Formed in the support frame 71 are a plurality of air holes 79 coupled to an air supply system via air supply control means 80.

Formed on a central peripheral portion of the cylindrical element 73 is a light reflecting surface 81 on which, as seen in FIG. 4 of the drawings, light is directed and received from and by a source and light cell 82.

The operation of the device 50 in gripping individual inner layers and displacing them towards the assembly table 31 on which they are deposited will now be described particularly with reference to FIG. 4 of the drawings wherein FIGS. 4*a*, 4*b* and 4*c* show the operation of gripping, displacement and depositing in successive stages.

The device 50 is displaced on the rail 51 so as to be disposed above the container 62. In this position the container 62 is displaced upwardly via the support 63 and the coupling rod 64 until contact is made between the uppermost layer 2 of the stack 68 and the lower planar surface 71*a* of the support frame 71. The upward displacement of the container 62 continutes until, as a result of the downward pressure exerted on the stack by the frame 71, the uppermost layer 2 of the stack 68 is displaced from the retaining catch 69.

In this position and with light directed from the light source 82 onto the reflecting surface 81, air flows out of the air holes 79 and, at the same time, the pneumatic displacement means 76 is actuated so as to cause the downward pivoting of the cylindrical element 73.

The airflow out of the air holes 79 passing above the stacked layers results in the effective separation of successive layers. At the same time and as the cylindrical element 73 descends towards the stack, the gap between the cylindrical element 73 and the frame flange 71b steadily reduces until the gap is of such a dimension that the air flow passing above this gap causes, by a venturi type effect, a suction force to arise which effectively raises the uppermost layer into a position, as shown in FIG. 4*a* of the drawings, wherein the edge of the uppermost layer folds around the cylindrical element 73 and effectively masks the peripheral reflecting surface 81. With the masking of this reflecting surface, a signal from the light cell 82 is received by the central processor unit and, as a consequence, the pneumatic displacement mechanism 77 for the clamping fingers 75 is actuated causing the clamping fingers 75 to pivot downwardly so as to clamp the edge of the inner layer against the cylindrical element 73.

With the inner layer thus gripped, the device 50 travels along its rail 51 carrying with it the now flipped over inner layer through the position shown in FIG. 4*b* into the position shown in FIG. 4*c*.

The displacement of the device 50 continues until the righthand end of the inner layer is disposed above the vacuum holes 40 at which stage a vacuum is exerted firmly attaching the righthand end of the shell element to the assembly surface. The clamping fingers are pivoted in an anticlockwise direction thereby releasing the lefthand end of the element from the device, the element itself being flattened onto the surface 17 by an air blast from the air nozzle 52 and the device 50 itself returning to its initial position as shown in FIG. 4*c* of the drawings.

In the foregoing description, use of the device 50 has been described with reference to a stack 68 of inner layers 2 which are located in the container 62 in a "face down" disposition and therefore the device 50 functions not only to grip each layer but also to flip it over so that it is located on the assembly surface in a "face up" disposition.

In an alternative arrangement, schematically illustrated in FIGS. 6*a* and 6*b*, the inner layers 2 are located in the container 62 in a so-called "face to face" disposition and, in such a disposition, the layers 2 are effectively located in the container 62 in successive pairs, each pair consisting of a "face up" layer and a "face down" layer. Whilst the "face down" layers can continue to be gripped and displaced by a device such as that described above, it will readily be appreciated that a "face up" layer will have to be located on the assembly surface without being flipped over. Thus, for this purpose, a modified gripping and displacing device 50' is provided. In this modified device 50' a carrier arm 83 supports at opposite ends of thereof component devices 84a and 84b substantially identical with the device 50 described with reference to FIGS. 4 and 5 of the drawings. Thus it will be readily seen that where the device 50' is to grip, displace and deposit a "face down" outer layer, then, as seen in FIG. 6a the righthand component device 84b is employed to grip the righthand edge of a layer in a manner identical with that described above with reference to FIGS. 4 and 5 of the drawings. Where, however, the device 50' is designed to grip, displace and deposit a "face up" inner layer, the lefthand device 84a is employed which, as seen in FIG. 6b, grips the lefthand end of the "face up" inner layer and deposits it on the assembly surface 17 without being flipped over.

Reverting now to FIG. 3 of the drawings, there are now disposed on the assembly surface 17 of the assembly table 31, an inner layer 2 whose righthand end is pressed down onto the surface by means of the vacuum effected through the vacuum holes 40 and which has been effectively flattened on the surface by the air blast from the nozzle 52 and an outer cuff unit 5 which is held down on the assembly surface 17 by the vacuum effective through the vacuum holes 39. The cuff unit 5 and the layer 2 are located side by side and spaced apart in relatively non-determined spatial disposition and with only the length of the outer layer 1 being known and stored in the central processor unit.

Figure 7:
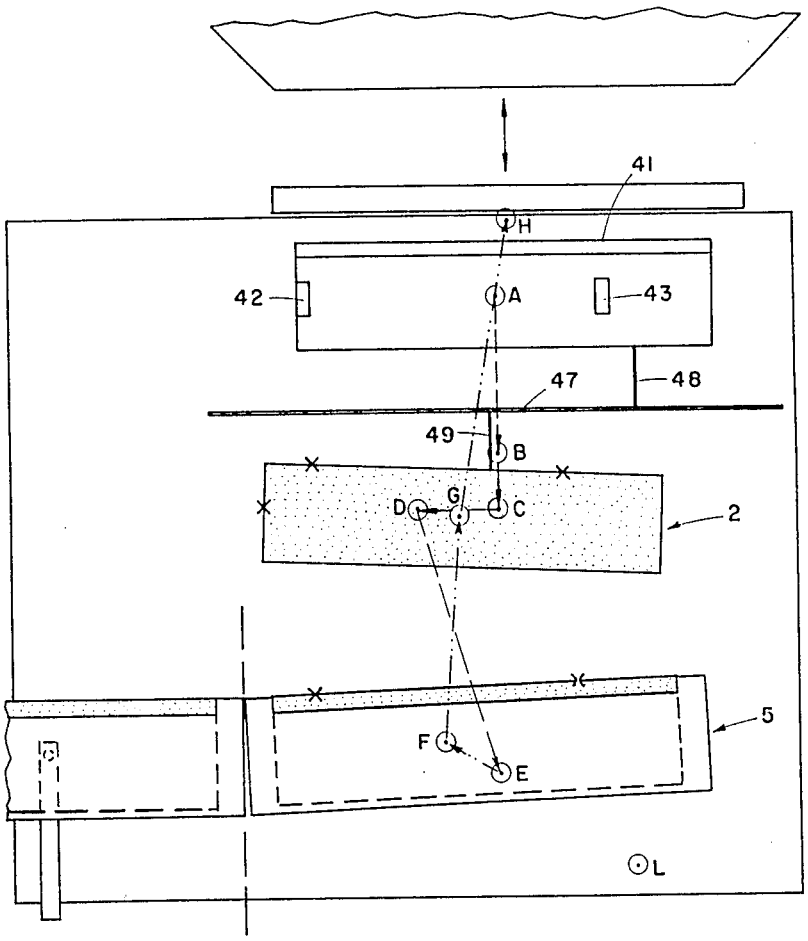
FIG. 7 is a schematic representation showing the movement of a tracking and displacing arm forming part of the system.

The use of the tracking and displacing arm 41 in determining the spatial coordinates of the layers 1 and 2, in displacing them into a relatively superimposed position and in displacing the superimposed elements to a loading mechanism will now be described with reference to FIG. 7 of the drawings which shows schematically the path of movement of a central point of the arm 41.

As a first step there must be effected the effective zeroing of the arm as far as its spatial coordinates are concerned. This is effected in two stages.

In a first stage the arm 41 is displaced so that it is located in the lowermost righthand corner of the assembly surface with its central position coinciding with the point L. This position denotes the effective extremity of the movement of the arm 41.

The arm 41 is then returned to the position where its centre point coincides with the point A and from this position the effective calibration of an arm servo displacing mechanism with respect to the X and Y coordinates and with respect to a rotational coordinate $\theta$ is effected. For this purpose the arm 41 is moved from position A to the position B as a result of which the sensors 42 and 43 cross the Y calibration line 47 thereby defining the zero Y and zero $\theta$ position. Similarly by moving the arm into a position (not shown) whereby the sensor 43 crosses the calibration line 48, a zero X position is defined. With the effective calibration of the mechanism the arm is displaced downwardly into the C position at which the sensors 42 and 43 cross the upper longitudinal edge of the inner layer 2 at the points indicated and the (X, Y, $\theta$) coordinates of these points, are duly stored in the central processor unit. It will be appreciated that by virtue of having established the coordinates of two points along a straight line the angular $\theta$ coordinate of this line is also established and stored.

The arm is then moved to the left to the position D so that its sensor 42 crosses the lefthand edge of the inner layer at the point indicated and the coordinates of this point are duly determined and stored. By determining and storing the coordinates of the three points of the inner layer 2 the coordinates of the upper lefthand corner of the inner layer 2 is determinable and can be stored.

The arm is then displaced to the position E in which position the sensors 42 and 43 will have crossed the upper edge of the outer layer 1 at the points indicated thereby determining the coordinates of the points which are duly stored in the central processing unit.

Knowing the coordinates of the two points along the upper edge of the outer layer 1 and with the information already stored in the central processing unit concerning the length of the outer layer 1, the central processing unit determines the points F and G which are respectively the central points of the deposited layers 1 and 2 and to which the arm 41 is to be displaced.

The arm 41 is thereupon displaced to the point F and is rotationally displaced into a "Fit" position determined by the coordinates of the two points along the upper edge of the outer layer 1 and in this position the arm 41 is completely aligned with the outer layer 1. The arm 41 is then lowered into contact with the cuff unit 5, the suction forces exerted on the cuff unit 5 via the vacuum holes 39 are discontinued and, at the same time suction forces are applied to the cuff unit 5 via the arm 41 so that the cuff unit 5 becomes attached to the arm 41. With the cuff unit 5 so attached, the arm 41 is displaced to the previously computed point G lying at the centre of the inner layer 2 and the arm is rotated into the angular position of the inner layer 2 as determined by the previously determined corrdinates of the sensed points lying at the upper edge of the inner layer 2 and in this way, the arm 41 becomes aligned with the inner layer 2 and is lowered into position on top of the inner layer 2 with the foremost longitudinal edge portion 6 of the inner layer 2 projecting outwardly.

The arm 41 now rests on the assembly surface 17 via the interposed layers 1 and 2 and the suction forces acting on the layer 1 so as to attach the latter to the arm 41 are now interrupted. The arm 41 now moves along the surface 17 taking with it the superimposed layers 1 and 2 until it reaches the position H to await being transferred to the loading mechanism 20 to be described below.

After the removal of the superimposed layers by the loading mechanism 20 to be described below, the arm 41 returns to its initial position A where it is ready, after a repeated calibration to repeat the above-referred to process.

With the mode of operation just described, it will be recalled that the determination of the positional coordinates of the outer layer 1 is effected by displacing the arm 41 from the point D to the point E, thereby causing the sensors 42 and 43 to traverse the upper edge of the outer layer 1, this providing information concerning the coordinates of two points along this upper edge. As was also explained, the coordinates of the lefthand edge of the outer layer 1 are already known, seeing that information concerning the length of this layer together with information concerning the position of the upper left hand corner thereof vis a vis the knife mechanism are stored in the central processor unit. However, it will be realized that, at the initiation of the process, the first, initial cuff unit 5 is deposited on the assembly surface 17 after having been severed from succeeding cuff units without any information having been transmitted to the central processor unit regarding the length of this first outer layer 1. In order to cope with this problem and in view of the fact, as stated above, that both inner and outer layers 1 and 2 are of identical lengths, the following procedure is adopted.

After the outer layer 1 has been deposited on the assembly surface 17, the first inner layer 2 is manually deposited on the assembly surface 17 in such a manner that the median line 49 is disposed normal to the layer 2 and with its extension bisecting the layer 2. The arm 41 is then moved through the positions C and D so as to determine, as indicated above, the respective coordinates of the layer 2. From these coordinates and from the X coordinate of the median line 47, the length of the layer 2 can be calculated and stored in the central processor unit. This length, as indicated above, is identical to the length of the layer 1 and in consequence the length thereof is known and is stored in the central processor unit. By virtue of the fact that the length of the layer 1 is known, the positioning of the arm 41 with respect to the layer 1 proceeds as described above.

Figures 8A, 8B, 8C, 8D, 8E, 8F, 8G:
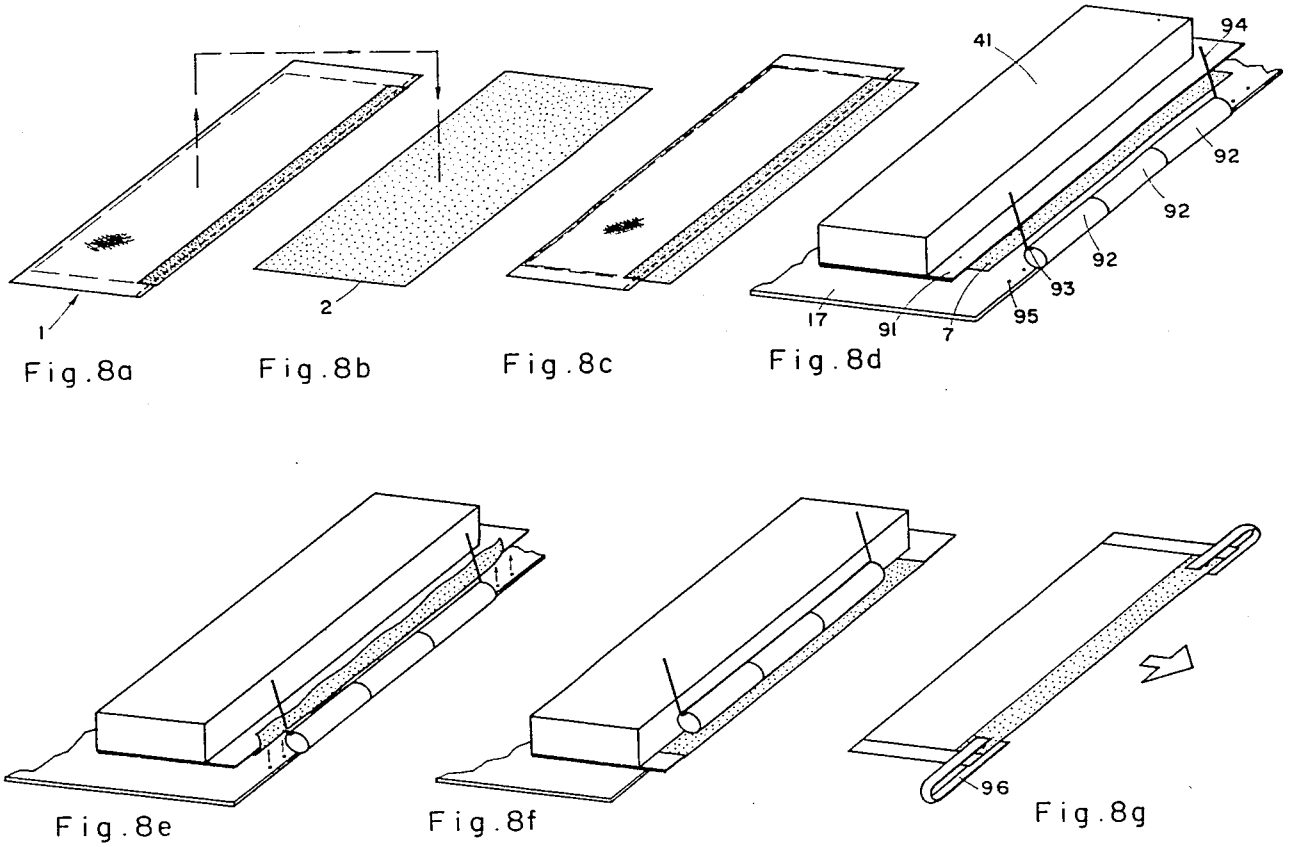
FIGS. 8*a*, 8*b*, 8*c*, 8*d*, 8*e*, 8*f* and 8*g* show schematically the displacement into superimposed disposition of constituent flexible layers and the subsequent folding over and gripping of the assembled layers.
Figure 9:
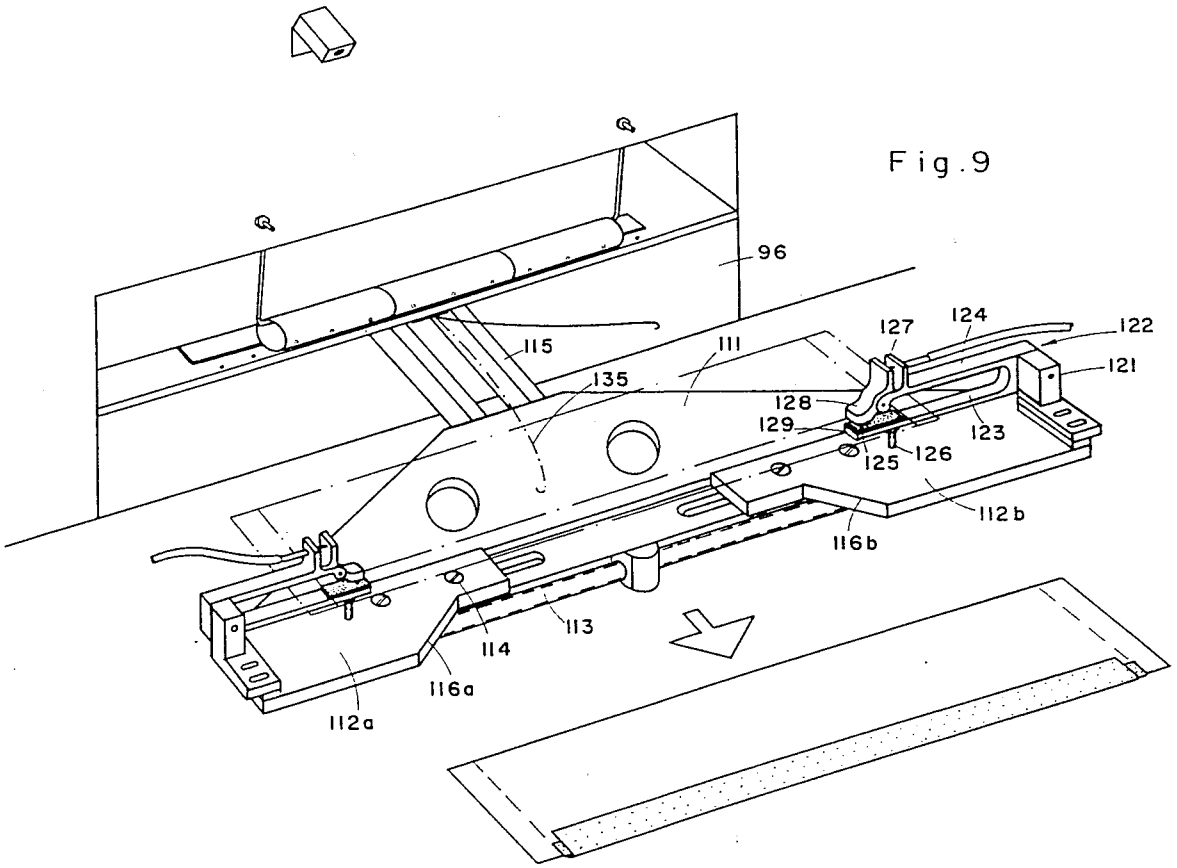
FIG. 9 is a perspective view of a loading mechanism forming part of the system in accordance with the present invention.

Reference will now be made to FIGS. 8*a*–8*g* of the drawings in which are schematically summarized the displacement and superposition of the cuff unit 5 and inner layer 2 and the positioning of the superimposed layers below the arm 41 in the position identified by the point H in FIG. 7 where it awaits transfer to the loading mechanism 20. As seen schematically in FIG. 8*d* the arm 41 rests on the assembly surface 17 there projecting from under the arm 41 the projecting longitudinal edge 6 of the inner layer 2, this projecting edge 6 being juxtaposed with respect to a longitudinally extending flange 91 formed integrally with the arm 41. A plurality of aligned tubular elements 92 are rotatably mounted on an axle 93 which is suspended fixedly from a pair of fixed positions with respect to the assembly table 31 by means of integrally formed suspension arms 94 which, as seen in FIGS. 8 and 9 of the drawings are rigidly suspended from the assembly table structure 96.

It will be readily seen that the tubular elements 92 are rotatable with respect to the axle 93 and are capable of a limited degree of motion in a direction perpendicular to the axle 93 with respect thereto.

Formed in the assembly surface adjacent to and in advance of the aligned tubular elements 92 are aligned airblow holes 95. With the arm 41 in its waiting position at H, once a signal has been received that loading can proceed, air is directed through the holes 95 and the arm 41 advances towards the aligned tubular elements 92 as seen in the FIG. 8*e* of the drawings. The air coming from the blowholes 95 causes the protruding edge 6 to be raised and when in this raised position the arm 41 has advanced to the aligned tubular elements 92, the latter passing over the raised edge 6 press the latter down onto the flange 91 as shown in FIG. 8*f* of the drawings. In this position, the superimposed layers with the pressed over protruding edge 6 are held by a pair of gripping units 97 as seen in FIG. 8*g* of the drawings, the thus gripped superimposed layers are removed from the arm 41 and the tubular elements 92 and presented to the cuff hemming unit 22.

The passage of the superimposed layers to the gripping elements 97 shown schematically in FIG. 8*g* and the nature of the latter will now be described in detail with reference to FIGS. 9 to 11 of the drawings.

Figure 10:
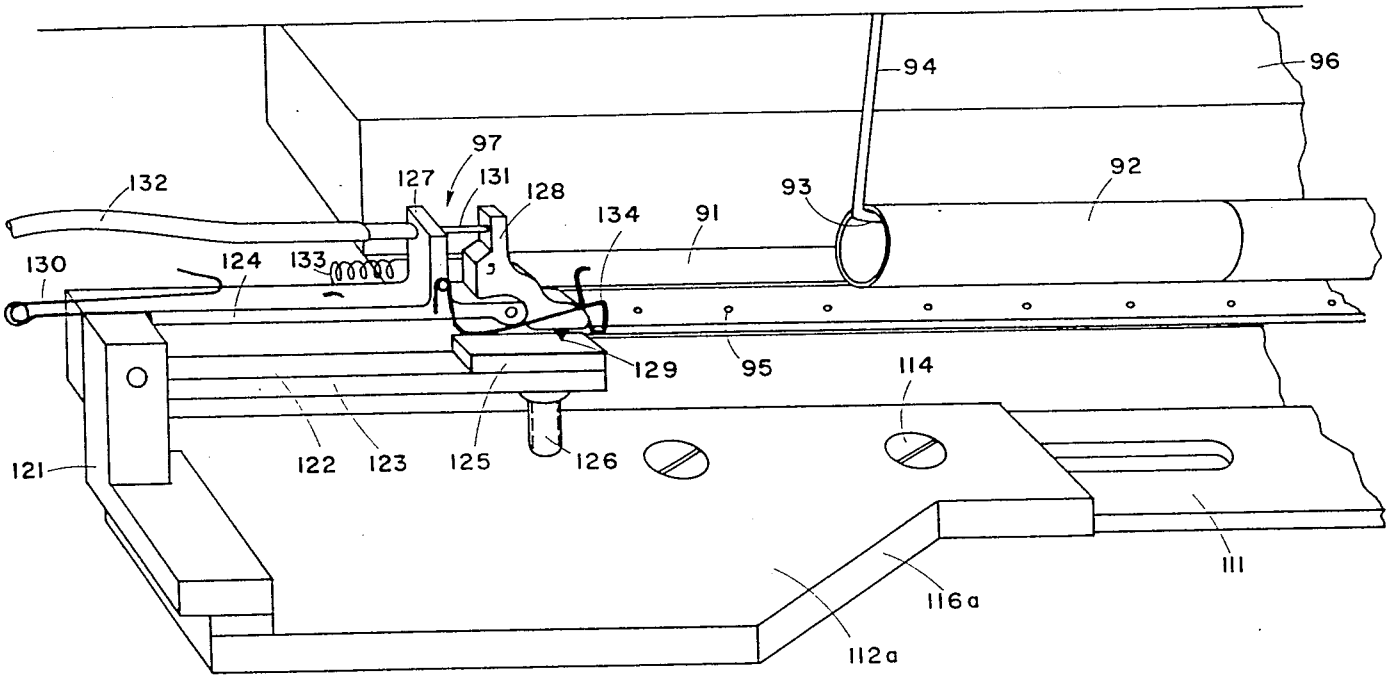
FIG. 10 is a view on an enlarged scale of a portion of the loading mechanism shown in FIG. 9.

The loading mechanism, as shown in FIGS. 9 and 10 of the drawings, comprises a platform 111 which is normally juxtaposed with respect to the assembly table structure 96 towards the cuff hemming unit 22 for the purpose of delivering the assembled layers 22 to the respective receiving station 21 thereof. FIG. 9 shows the platform 111 displaced from the assembly table structure 96 whilst in the view shown in FIG. 10 the platform 111 is shown juxtaposed with respect to the structure 96. A pair of frame brackets 112*a* and 112*b* are mounted on the platform 111 and are spaced apart with respect to the centre of the platform, the spacing being variable by means of a rotatable screw rod 113. Screw bolts 114 are provided for clamping the brackets 112*a* and 112*b* in any predetermined spaced apart position.

The platform 111 is displaceable to and from the assembly table structure 96 by means of a displacement rod 115. Reference to FIG. 11 shows that the platform 111 is not only capable of axial movement with respect to the table structure 96 but is also capable of a limited degree of angular movement so as to enable the brackets 112*a* and 112*b* which are provided with suitable inclined edges 116*a* and 116*b* to adapt themselves to variations in the position of the receiving stations 21.

Mounted on each bracket 112 is the gripping unit 97 (shown schematically in FIG. 8*g*). Each gripping unit 97 comprises a mounting block 121 on which is mounted a U-shaped bracket 122 having limbs 123 and 124. The U-shaped bracket 122 is pivotally mounted with respect to the block 121. The limb 123 is formed adjacent its free end with a frictional gripping surface 125 and a height adjusting screw 126. It will be readily seen that the adjustment of the screw 126 raises or lowers the frictional gripping surface 125. The upper limb 124 is formed integrally with a planar projection 127 and is pivotally coupled, at an end portion thereof, to a pin bearing member 128 which carries a pin 129. The U-shaped bracked 122 as a whole is downwardly biased by means of a biasing spring 130.

The pin bearing member 128 is abutted by a displacing rod 131 which is pneumatically actuated by a pneumatic drive coupled thereto by a pneumatic line 132. Thus displacement of the pin bearing member 128 as a result of a pneumatic impulse pivots the bearing member 128 in a clockwise sense so that the pin 129 approaches the frictional surface 125. This pivoting of the pin bearing member 128 in the clockwise sense is against the biasing force exerted by a tension spring 133 which tends to pivot the pin bearing member 128 in an anticlockwise sense.

In order to facilitate the insertion of the folded over edge of the assembled layer into the loading mechanism between the pin bearing member 128 and the frictional surface 125, each gripping device is provided with a guide spring 134 between which and the frictional surface the folded over edge of the assembled layers can be readily introduced.

Projecting from the table structure 97 underneath the assembled layers so as to support the central portion thereof against sagging is an elongated support wire 135.

In use, the arm 41 advances the assembled layers with its edge folded over by means of the aligned tubular elements 92 so as to introduce the folded over edge between the pin bearing member 128 and the frictional surface 125. The assembled layers are now firmly gripped by the loading mechanism 20 which is now displaced towards an oppositely disposed receiving station 21. It will be understood that the frictional gripping of the assembled layers by the gripping units 97 overcomes the retention of the layers on the assembly surface 17 by the arm 41 and in this way the assembled layers are displaced away from the arm 41.

Reference will now be made once more to FIG. 2 of the drawings, from which it can be seen that the loading mechanism 20 presents the assembled layers to a suitably vacant receiving station 21 of the cuff hemming unit 22 which grips the assembled layers now released by the loading mechanism 20 and moves them successively to a sewing head 23 and a trimming head 24 and subsequently to an unloading station 26.

In order to allow for the correct and close alignment and correlation between the gripping units 97 and the loading mechanism 20 the latter is provided a relative degree of freedom of angular displacement as schematically seen in FIG. 11 of the drawings. As can be seen there, the displacement rods 115 by means of which the platform 111 and the brackets 112 are displaced to and from the receiving station 21 are pivotal about an axis 117 whilst the platform 111 itself is pivotal about an axis 118.

It should be understood that close correlation is required between the constituent (inner and outer) layers 1 and 2 which are designed to be assembled into a single cuff. Thus there must be very strict correlation between the stacks or bundles of inner layers 2 and the corresponding number of outer layers 1 formed on the continuous length of lining 12. This correlation can be ensured by having the initial or final layer of each stack suitably coded with an optically readable code which is to correspond with a corresponding coding to be found at predetermined intervals on the continuous length of outer layers 1. The programming of the central processor unit is such as to cause the interruption of the assembly where any mis-correlation takes place.

Furthermore, it is very often required to provide an easy method of distinguising between successive bundles of assembled and hem-stitched cuff units. This can once more be achieved by ensuring the coding of the final inner and/or outer layer of each bundle.

Figure 12:
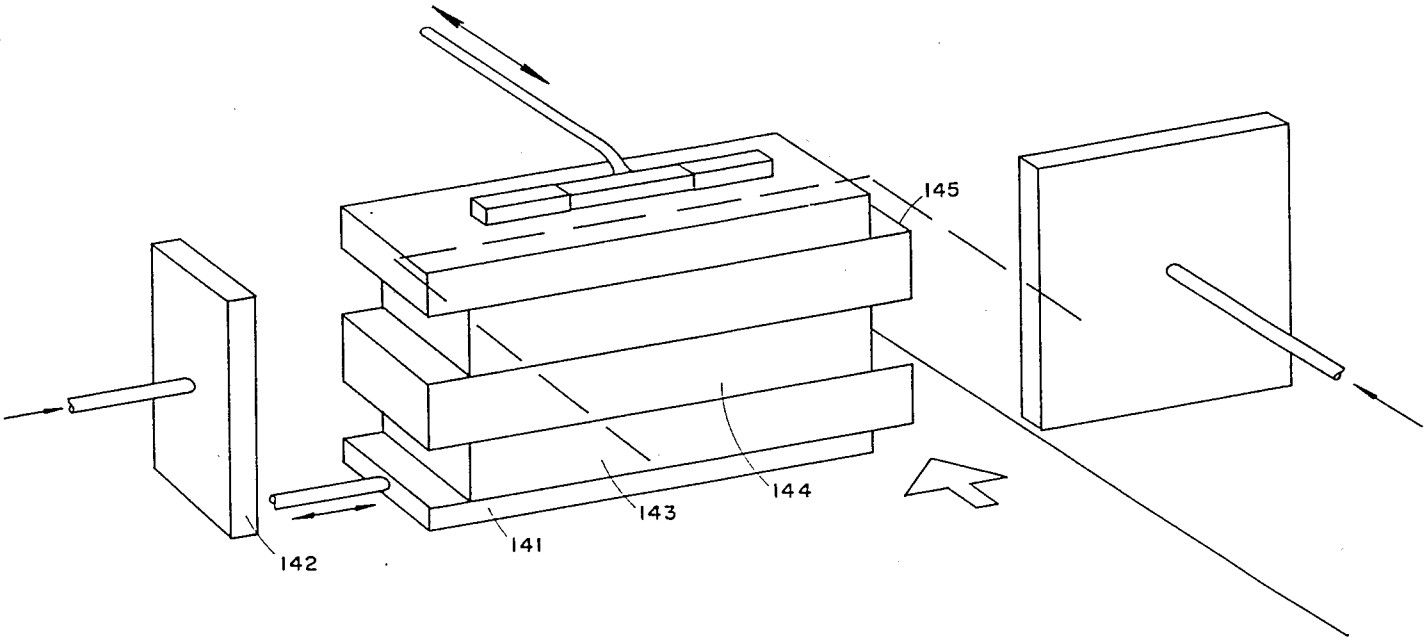
FIG. 12 shows schematically the mode of depositing hemmed cuffs in visually distinct stacked bundles.

Thus, as can be seen in FIG. 2 of the drawings, the hemmed and trimmed cuffs are removed by a suitable raking mechanism 25 to an unloading station 26. As can be seen in FIG. 12 of the drawings, the raking mechanism 25 is instrumental in depositing the hemmed cuffs on a suitable loading platform 141. This loading platform 141 is shown responsively coupled to a displacing element 142 and, after a predetermined number of hemmed cuffs forming a first stack bundle 143 are deposited on the loading platform 141 (this number being determined by the appearance of the coded layer in the system), the displacing element 142 is provided with a displacing impulse as a result of which the loading platform 141 is displaced in a given sense. After a subsequent, predetermined number of hemmed cuffs constituting a second stack bundle 144 are located on the already deposited first stack bundle 143, the displacing element 142 transmits to the platform 141 a displacing impulse in an opposite sense. In this way and as can be seen in the Figure, a stack of successive stack bundles is built up on the supporting platform 141 wherein each stack bundle is visibly distinguished from the preceding or succeeding bundle by being spatially staggered with respect thereto.

When a predetermined number of stack bundles have been suitably stacked on the supporting platform 141 they are displaced onto a normally directed surface 145 or transmission belt from which it can be removed.

As stated above, the operation of the system is controlled by a suitably programmed, central processor unit from which computer commands flow for the purpose of facilitating the appropriate stages in the system. These stages have all been described above and FIGS. 13–17 are incorporated within the description for the purpose of illustrating the flow of the basic computer commands, it being understood that in practice the computer can be programmed to issue various subsidiary commands as required.

Figure 13:
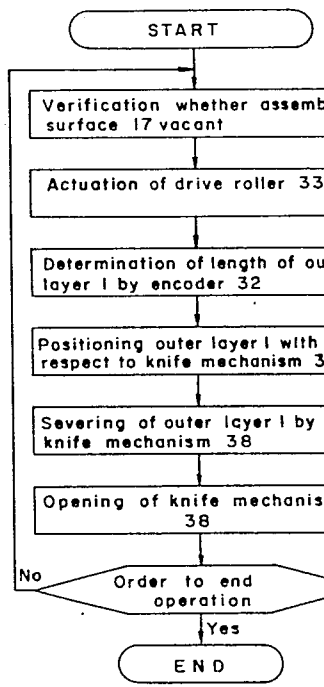
FIGS. 13, 14, 15, 16 and 17 illustrate the flow of computer commands in connection with various operational steps of the system.
Figure 16:
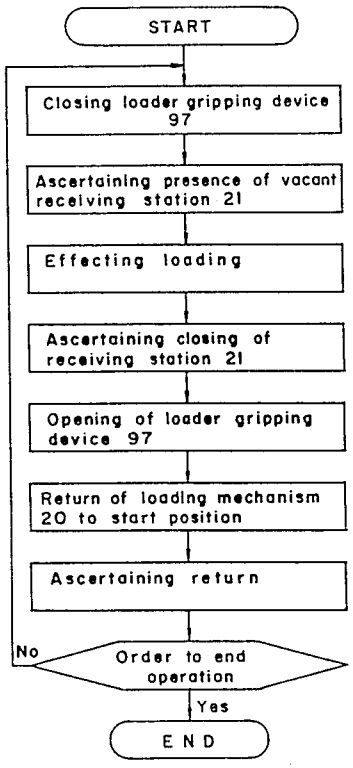
Figure 17:
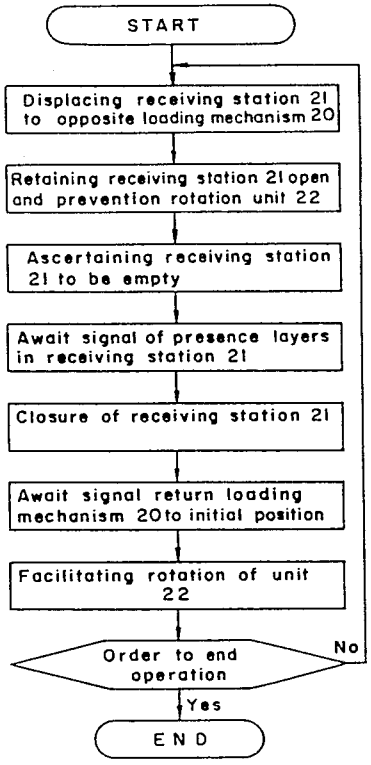
Figure 14:
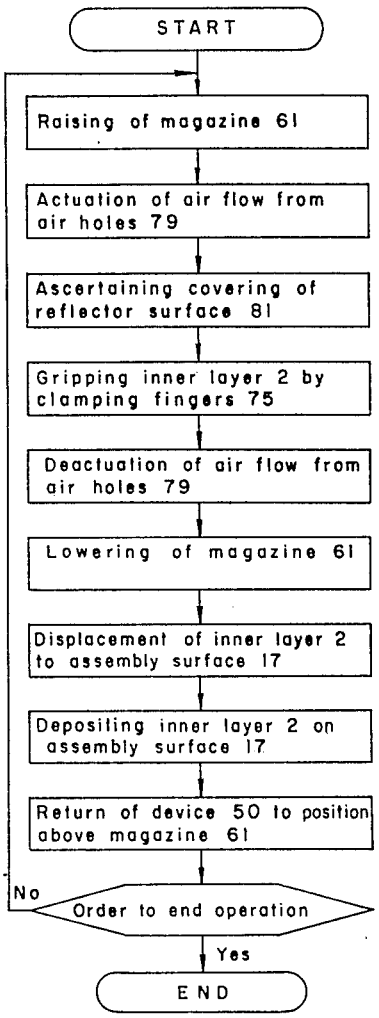
Figure 15:
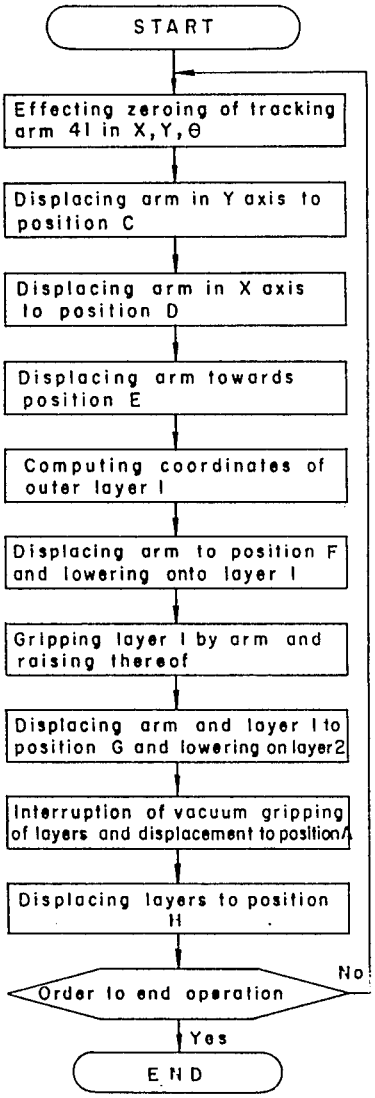

Thus, FIG. 13 illustrates the flow of computer commands in connection with the feeding and deposition on the assembly surface 17 of the outer cuff units 5;

FIG. 14 illustrates the flow of computer commands in connection with the feeding and deposition on the assembly surface 17 of the inner cuff layers 2;

FIG. 5 illustrates the flow of computer commands in connection with the displacement of the tracking and displacing arm 41;

FIG. 16 illustrates the flow of computer commands in connection with the operation of the loading mechanism 20; and FIG. 17 illustrates the flow of computer commands in connection with the operation of the cuff hemming unit 22.

Whilst the application of the system and method in accordance with the invention has been specifically described with reference to the assembly and loading of flexible fabric layers for the manufacture of shirt cuffs, the invention is clearly and equally applicable in connection with the manufacture of other sewn items and also in connection in connection with other objects which need not necessarily be flexible or even planar.

I claim:

1. A system for displacing substantially planar objects into a predetermined disposition, comprising:

depositing means for depositing said objects on a supporting surface in a relatively spaced apart disposition;

a tracking arm;

a pair of spaced apart optical sensors carried by said tracking arm for successively sensing positional coordinates of each object and transmitting data relating to said coordinates for storage in a programmed central processor unit;

arm displacing means for displacing said tracking arm over said supporting surface in any required direction; and object displacing means for displacing each object with respect to a succeeding object in an order reverse to the order of sensing so as to locate each object in a predetermined relative disposition with respect to the position of said succeeding object as stored in said processor unit, said object displacing means being formed integrally with said tracking arm and comprising an object gripping surface formed on said arm, said arm displacing means being capable of displacing said arm towards and away from said surface.

2. A system according to claim 1 wherein suction holes are formed in said gripping surface through which a suction gripping force can be exerted on a planar object.

3. A system according to claim 2 wherein said depositing means includes a planar layer gripping and displacing device which comprises a clamping surface, pivotably clamping fingers, air suction means for displacing by suction a planar layer to be displaced on to said clamping surface and clamping fingers displacement means for pivotably displacing said fingers into clamping engagement with said clamping surface.

4. A system according to claim 3 wherein said air suction means comprises one or more air blast nozzles for directing an air blast between said clamping surface and an adjacent frame of said displacing device and above the layer to be gripped so as to generate a suction displacing force on said layer.

5. A system according to claim 4 wherein said clamping surface is formed on a cylindrical element located with its axis substantially parallel to the plane of the layer to be gripped, said cylindrical element being pivotably displaceable towards and away from said layer.

6. A system according to claim 5 wherein said blast is also directed towards a stack of said layers so as to separate the uppermost layers.

7. A system according to claim 5 wherein sid cylindrical element is formed with a reflecting surface, there being furthermore provided optical sensing means directed on to said reflecting surface and being actuatable upon said reflecting surface being covered by a layer.

8. A system according to claim 7 wherein means are provided for displacing said gripping and displacing device to and from a layer storage station.

9. A system according to claim 8 wherein a pair of gripping and displacing devices are provided, mounted on a common arm and respectively directed to gripping opposite ends of a layer.

10. A system according to claim 9 wherein there is furthermore provided a layer storage station comprising a layer container holder, holder displacing means for displacing said holder to and away from said displacing and gripping device, a support platform located in said container and resting on compression spring means tending to bias said platform towards an open end thereof adjacent said gripping and displacing device and means for limiting the displacement of said platform in said container under the influence of said compression spring means.

11. A system according to claim 10 wherein said displacing means is adapted to displace said planar objects into a relatively superimposed disposition with one of said layers projecting beyond the remaining layer(s), folding means being provided for folding over the projecting portion over the adjacent edges of the remaining layer(s).

12. A system according to claim 11 wherein said folding means comprises a plurality of aligned tubular members mounted for free rotation about an axis substantially parallel to said surface and capable of limited movement towards and away from said surface, said displacing means being designed to displace the superimposed planar objects towards and under said tubular elements, air blow means being provided for raising the projecting portion from said surface prior to passing under said aligned tubular elements whereby said projecting portion is folded over by the pressure exerted by said tubular elements.

13. A system according to claim 12 wherein there is furthermore provided a loading mechanism adapted to receive and releasably to retain superimposed planar objects and to displace said superimposed objects to a loading station.

14. A system according to claim 13 wherein said loading mechanism comprises a loading platform, a pair of actuatable gripping devices located at either end of said platform, means for actuating said gripping devices so as releasably to grip edges of superimposed planar objects.

15. A system according to claim 14 for displacing and superimposing flexible fabric layers and for presenting them for processing to a hemming unit.

* * * * *